US009356353B1

(12) United States Patent
Manry, Jr.

(10) Patent No.: US 9,356,353 B1
(45) Date of Patent: May 31, 2016

(54) COG RING ANTENNA FOR PHASED ARRAY APPLICATIONS

(75) Inventor: Charles W. Manry, Jr., Auburn, WA (US)

(73) Assignee: The Boeing Company, Chicago, IL (US)

( * ) Notice: Subject to any disclaimer, the term of this patent is extended or adjusted under 35 U.S.C. 154(b) by 252 days.

(21) Appl. No.: 13/476,953

(22) Filed: May 21, 2012

(51) Int. Cl.
*H01Q 9/04* (2006.01)

(52) U.S. Cl.
CPC ..... *H01Q 9/0464* (2013.01); *H01Q 9/0435* (2013.01)

(58) Field of Classification Search
CPC .... H01Q 9/0464; H01Q 1/526; H01Q 9/0435
USPC ..... 343/741
See application file for complete search history.

(56) References Cited

U.S. PATENT DOCUMENTS

| | | | | |
|---|---|---|---|---|
| 3,754,271 | A | 8/1973 | Epis | |
| 5,194,876 | A * | 3/1993 | Schnetzer et al. | 343/746 |
| 5,539,420 | A * | 7/1996 | Dusseux | H01Q 9/0457 343/700 MS |
| 5,940,037 | A * | 8/1999 | Kellerman et al. | 343/700 MS |
| 5,995,058 | A * | 11/1999 | Legay et al. | 343/789 |
| 8,081,062 | B2 * | 12/2011 | Son | H01P 5/18 333/117 |
| 8,749,446 | B2 | 6/2014 | Manry, Jr. et al. | |
| 8,773,323 | B1 | 7/2014 | Manry, Jr. et al. | |
| 8,912,970 | B1 | 12/2014 | Manry, Jr. et al. | |
| 2003/0210193 | A1 * | 11/2003 | Rossman et al. | 343/700 MS |
| 2005/0237259 | A1 * | 10/2005 | Stephens | 343/841 |
| 2012/0268347 | A1 * | 10/2012 | Tatarnikov et al. | 343/893 |

FOREIGN PATENT DOCUMENTS

EP 2551959 B1 4/2014

OTHER PUBLICATIONS

Jin-Sen Chen, "Dual-Frequency Annular-Ring Slot Antennas Fed by CPW Feed and Microstrip Line Feed," IEEE Transactions APS, vol. 53, No. 1, Jan. 2005, p. 569-571.
Yu-Jiun Ren, "An Ultrawideband Microstrip Dual-Ring Antenna for Millimeter-Wave Applications," IEEE Antennas & Wireless Propagation Letters, vol. 6, 2007, p. 457-459.
A Das, B. Sc., M.sc, et al, "Radiation Characteristics of Higher-Order Modes in Microstrip Ring Antenna," IEE Proceedings, vol. 131, Pt H, No. 2, Apr. 1984, p. 102-103.
Weng Cho Chew, "A Broad-Band Annular-Ring Microstrip Antenna", IEEE Transactions APS, vol. AP-30, No. 5, Sep. 1982, Section I p. 918-919, Section V p. 920-921.
I.J. Bahl, et al, "A New Microstrip Radiator for Medical Applications," IEEE Transactions on Microwave Theory and Techniques, vol. MTT-28, No. 12, Dec. 1980, p. 1464-1468.
Olaode, O. ; Palmer, W. ; Joines, W., "Effects of Meandering on Dipole Antenna Resonant Frequency", Antennas and Wireless Propagation Letters, IEEE vol. 11, Jan. 2012.
Cristal, E.G., "Meander-Line and Hybrid Meander-Line Transformers", Microwave Symposium, 1972 IEEE GMTT International, May 1972.

(Continued)

*Primary Examiner* — Hoang V Nguyen
*Assistant Examiner* — Michael Bouizza
(74) *Attorney, Agent, or Firm* — McDonnell Boehnen Hulbert & Berghoff LLP

(57) ABSTRACT

An antenna structure and methods are presented. A conductive resonator comprises a conductive ring configured to support an electromagnetic current, and a plurality of conductive teeth. The conductive teeth are distributed around an edge of the conductive ring, and are configured to control a flow of the electromagnetic current and tune a response of the antenna structure.

18 Claims, 7 Drawing Sheets

(56) References Cited

OTHER PUBLICATIONS

Hockham, G.; Wolfson, R, "Broadband meander line planar array antenna", Antennas and Propagation Society International Symposium, 1979.

Antenna Engineering Handbook, Third Edition, Johnson, Richard C, McGraw-Hill 1993.

Frequency Selective Surfaces, Theory and Design, Munk B., Wiley-Interscience 2000.

* cited by examiner

COG RING ANTENNA FOR PHASED ARRAY APPLICATIONS

FIELD

Embodiments of the present disclosure relate generally to antennas. More particularly, embodiments of the present disclosure relate to microwave and millimeter-wave frequency antennas.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications since beam steering can be accomplished electronically without physical motion of the antenna. Such electronic beam steering can be faster and more accurate and reliable than gimbaled/motor-driven mechanical antenna steering.

SUMMARY

An antenna structure and method are disclosed. A conductive resonator comprises a conductive ring configured to support an electromagnetic current, and a plurality of conductive teeth distributed around an edge of the conductive ring, and configured to control the flow of the electromagnetic current and tune a response of the antenna structure.

In this manner, the antenna structure provides a wide scan volume (e.g., better than 60 degrees of conical scan volume from boresight) and maintains good circular polarization axial ratio over specified frequency bands. The antenna structure minimizes size, weight, and power (SWAP), as well as minimizing integration cost. SWAP is greatly reduced by elimination of "stovepiped" Satellite Communication (SATCOM) narrow banded systems and associated separate antenna installations. The antenna structure provides a phased array antenna that can cover at least one SATCOM transmit and/or receive military Extremely High Frequency (EHF) band, while being thin and lightweight.

Furthermore, the antenna structure may be scaled to other frequency bands and phased array applications such as, for example but without limitation, Line-of-Sight communication links, Signals Intelligence (SIGINT) arrays, radars, sensor arrays, or other frequency band or phased array application. In addition, the antenna structure provides a conformal antenna operable to greatly reduce fluid dynamic drag and integration/maintenance cost.

In an embodiment, an antenna structure comprises a conductive resonator. The conductive resonator comprises a conductive ring configured to support an electromagnetic current, and a plurality of conductive teeth distributed around an edge of the conductive ring, and configured to control a flow of the electromagnetic current and to tune a response of the antenna structure.

In another embodiment, a method for forming an antenna structure provides a conductive resonator comprising a conductive ring, and configures a plurality of conductive teeth on an edge of the conductive ring.

In a further embodiment, a method for communication using an antenna structure excites electromagnetically a conductive resonator is electromagnetically coupled to a feed line. The conductive resonator comprises a conductive ring that supports an electromagnetic current, and a plurality of conductive teeth distributed around an edge of the conductive ring that controls a flow of the electromagnetic current and tune a response of the antenna structure.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
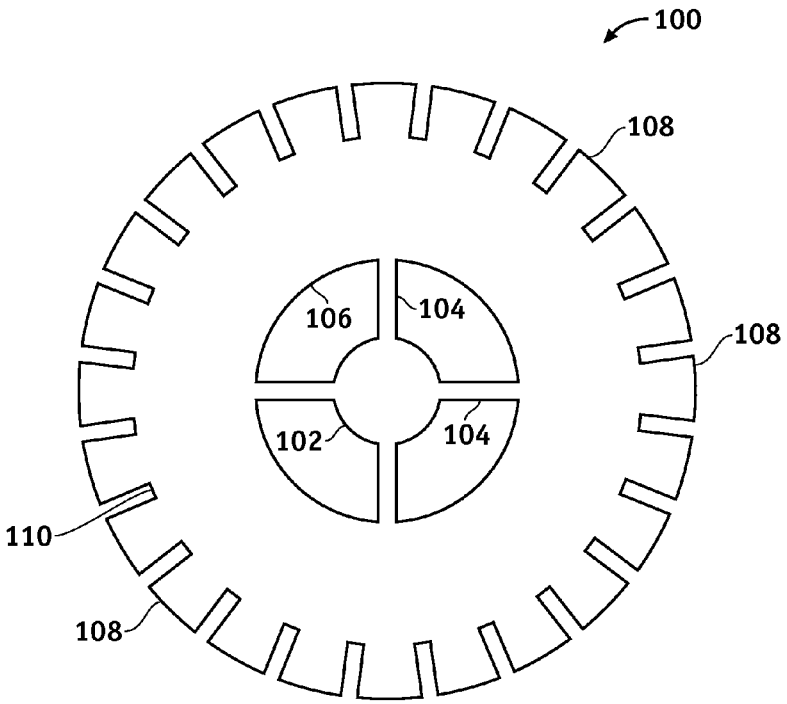
FIG. 1 is an illustration of an exemplary cog ring conductive resonator comprising teeth (cogs) on an outer edge thereof according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antenna design, antenna manufacturing, and other functional aspects of the systems (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a non-limiting application, namely, a planar or conformal satellite communication phased array antenna. Embodiments of the disclosure, however, are not limited to such planar satellite communication applications, and the techniques described herein may also be utilized in other applications. For example but without limitation, embodiments may be applicable to conformal antennas, manned and unmanned aircraft antennas, sensor antennas, radar antennas, and other antennas and phased arrays.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Current microwave scanning antennas use multiple phased array antenna apertures for each band and/or dual band dish antennas under radomes. On-aircraft dishes generally must be placed under aerodynamic radomes adding significantly to weight of an aircraft, aerodynamic drag and maintenance complication.

Embodiments of the disclosure provide a cog ring conductive resonator for a conformal phased array antenna element for a single/multi-band transmit and/or receive aperture for bi-directional satellite communication and other communications. Bands for bi-directional satellite communication and other communications may comprise, for example but without limitation, about 27.5-30 GHz for transmit commercial bands, about 30-31 GHz and about 43.5-45.5 GHz for transmit military bands, about 17.7-20.2 GHz for receive commercial bands, about 20.2-21.2 for receive military bands, signals in adjacent Ka-bands and Ku-band, or other frequency bands. Embodiments of the disclosure provide a light weight and very thin single transmit and/or receive conformal phased array antenna element that maintains good circular polarization axial ratio over specified frequency bands. Embodiments of the phased array antenna element may be used in a conformal phased array antenna element, with wide conical scan volume to about 60 degrees or greater angle from a boresight.

FIG. 1 is an illustration of an exemplary cog ring conductive resonator 100 (conductive resonator 100) comprising a plurality of teeth 108 (conductive teeth 108) distributed around an outer edge 110 of a ring resonator 106 (conductive ring 106) according to an embodiment of the disclosure. The conductive resonator 100 comprises an inner disk 102, a plurality of spokes 104, and a ring resonator 106 comprising the teeth 108 (cogs) on the outer edge 110 of the ring resonator 106.

The conductive resonator 100 is operable to resonate at electromagnetic frequencies to be received or transmitted. The conductive resonator 100 may comprise a receiver that resonates an incoming electromagnetic signal. Additionally or alternatively, the conductive resonator 100 may comprise a transmitter that resonates an outgoing electromagnetic signal. The conductive resonator 100 may comprise, for example but without limitation, a single resonator, a plurality of resonators, slotted resonators, resonators on multiple layers, or other resonator. The conductive resonator 100 may comprise, for example but without limitation, metallization, a microstrip, direct-write, or other conductor. The conductive resonator 100 may comprise any material suitable for operation of the conductive resonator 100 such as, for example but without limitation, copper, polysilicon, silicon, aluminum, silver, gold, steel, meta-materials, or other suitable material. The conductive resonator 100 may comprise, for example but without limitation, a spoke structure, a ring structure, a substantially planar shape, or other structure or shape.

The ring resonator 106 may support an electromagnetic flux (electromagnetic current) in a rotational circulation around the ring resonator 106. The ring resonator 106 may comprise a receiver that resonates an incoming electromagnetic signal producing the electromagnetic flux. The electromagnetic flux may be coupled by feed lines 416 and 418 (FIG. 4) to provide a received signal to receiver electronics. Additionally or alternatively, the ring resonator 106 may comprise a transmitter that circulates the electromagnetic flux to resonate an outgoing electromagnetic signal. The electromagnetic flux may be coupled by the feed lines 416/418 to a transmit signal from transmitter electronics. Flux, current, electromagnetic flux, and electromagnetic current may be used interchangeably in this document.

The teeth 108 on the outer edge 110 of the ring resonator 106 control a current flow around the outer edge 110 of the ring resonator 106. Control of the current flow allows an antenna comprising the ring resonator 106 to have good circular polarization, good axial ratio over specified frequency bands, and allows the antenna to be matched to other electronic components (e.g. a receiver and/or transmitter). The teeth 108 may comprise, for example but without limitation, a substantially square shape, a substantially trapezoidal shape, a substantially triangular shape, a substantially polygonal shape, a substantially rounded shape, or other shape. The teeth 108 may each comprise an area of, for example but without limitation, about 10 $mm^2$, about 15 $mm^2$, or other suitable area for an application. The teeth 108 may comprise a length from the outer edge 110 of, for example but without limitation, about 3 mm, about 5 mm, or other suitable distance for an application. While twenty four of the teeth 108 are shown around the outer edge 110 of the conductive resonator 100, in other embodiments other numbers of teeth may be used.

Figure 5:
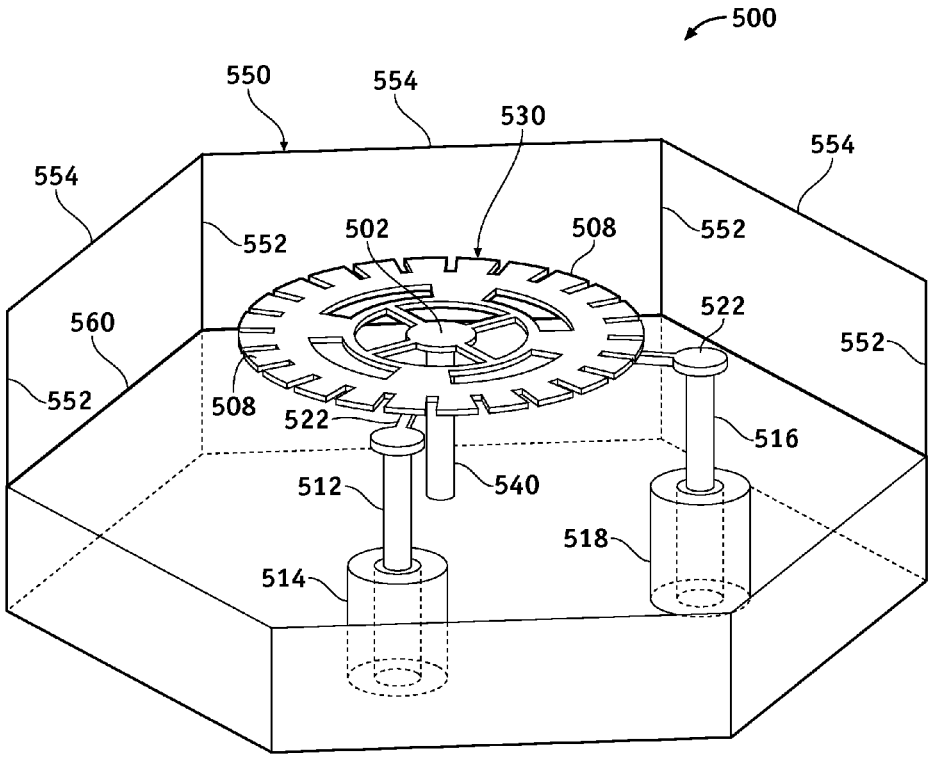
FIG. 5 is an illustration of an exemplary antenna structure according to an embodiment of the disclosure.

The spokes 104 electrically couple the ring resonator 106 to the inner disk 102. In the embodiment shown in FIG. 1, the conductive resonator 100 comprises the inner disk 102 and the ring resonator 106 coupled by one or more spoke 104 (spoke structure). In an alternate embodiment, the one or more spoke 104 may be omitted, or the one or more spoke 104 of the conductive resonator 100 may be significantly enlarged to tune an antenna structure 500 (FIG. 5).

The inner disk 102 may comprise a tuning element for the conductive resonator 100. The inner disk 102 may be electrically coupled to a shorting pin 540 (FIG. 5) to provide connectivity to the electromagnetically-shielding ground plane 560 (FIG. 5). In an alternate embodiment, disk 102 may be omitted.

Figure 2:
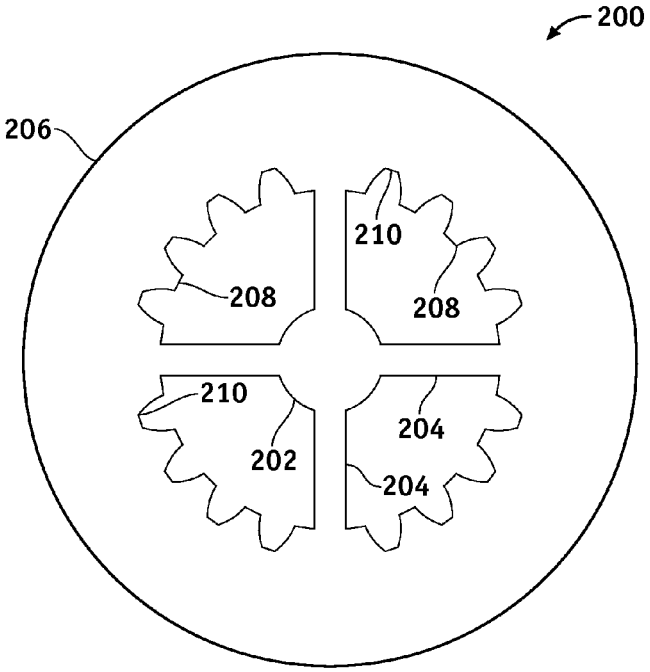
FIG. 2 is an illustration of an exemplary cog ring conductive resonator comprising teeth on an inner edge thereof according to an embodiment of the disclosure.

FIG. 2 is an illustration of an exemplary cog ring conductive resonator 200 (conductive resonator 200) comprising a plurality of teeth 208 (conductive teeth 208) distributed around an inner edge 210 of a ring resonator 206 (conductive ring 206) according to an embodiment of the disclosure. The conductive resonator 200 may have functions, material, and structures that are similar to the embodiments shown in FIG.

1. Therefore common features, functions, and elements may not be redundantly described here. The conductive resonator 200 comprises an inner disk 202, a plurality of spokes 204, and the ring resonator 206 comprising the teeth 208 on the inner edge 210 of the ring resonator 206.

The inner disk 202 may comprise a tuning element for the conductive resonator 200. The inner disk 202 may be electrically coupled to the shorting pin 540 (FIG. 5) to provide connectivity to the electromagnetically-shielding ground plane 560 (FIG. 5). In an alternate embodiment, disk 202 may be omitted.

The spokes 204 electrically couple the ring resonator 206 to the inner disk 202. In the embodiment shown in FIG. 2, the conductive resonator 200 comprises the inner disk 202 and the ring resonator 206 coupled by one or more spoke 204. In an alternate embodiment, the one or more spoke 204 may be omitted, or the one or more spoke 204 of the conductive resonator 200 may be significantly enlarged to tune an antenna structure 500 (FIG. 5).

The ring resonator 206 may support an electromagnetic flux in a rotational circulation around the ring resonator 206. The ring resonator 206 may comprise a receiver that resonates an incoming electromagnetic signal producing the electromagnetic flux. The electromagnetic flux may be coupled by the feed lines 416 and 418 (FIG. 4) to provide a received signal to receiver electronics. Additionally or alternatively, the ring resonator 206 may comprise a transmitter that supports the electromagnetic flux to resonate an outgoing electromagnetic signal. The electromagnetic flux may be coupled by feed lines to a transmit signal from transmitter electronics.

The teeth 208 on the inner edge 210 of the ring resonator 206 control a current flow around the inner edge 210 of the ring resonator 206. Control of the current flow allows for an antenna comprising the ring resonator 206 to have good circular polarization, good axial ratio over specified frequency bands, and allows the antenna to be matched to other electronic components (e.g. a receiver and/or transmitter). In the embodiment shown in FIG. 2, the teeth 208 comprise a substantially trapezoidal shape; however, the teeth 208 may comprise, for example but without limitation, a substantially square shape, a substantially triangular shape, a substantially polygonal shape, a substantially rounded shape, or other shape. The teeth 208 may each comprise an area of, for example but without limitation, about 10 $mm^2$, about 15 $mm^2$, or other suitable area for an application. The teeth 208 may comprise a length from the inner edge 210 of, for example but without limitation, about 3 mm, about 5 mm, or other suitable distance for an application. While twenty of the teeth 208 are shown around the inner edge 210 of the conductive resonator 200, in other embodiments other numbers of teeth may be used.

Figure 3:
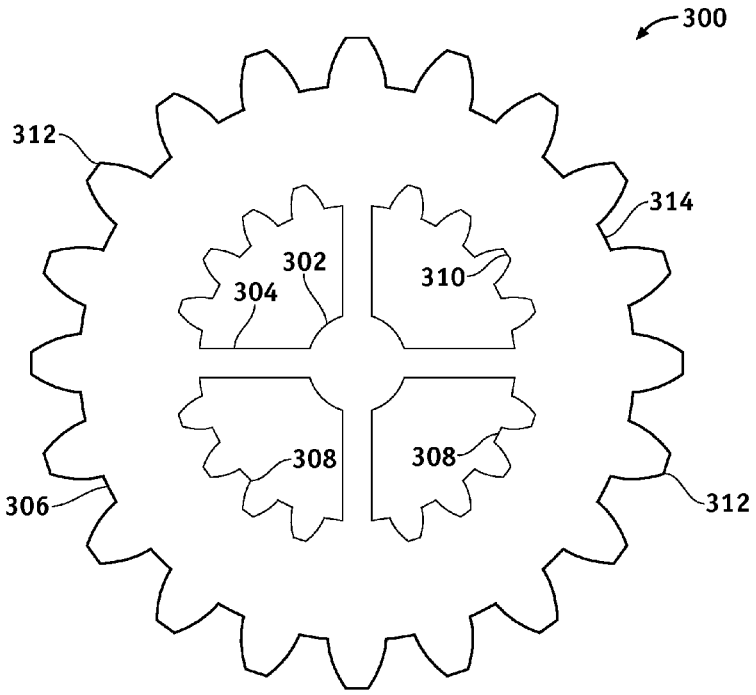
FIG. 3 is an illustration of an exemplary cog ring conductive resonator comprising teeth on an inner edge and an outer edge thereof according to an embodiment of the disclosure.

FIG. 3 is an illustration of an exemplary cog ring conductive resonator 300 (conductive resonator 300) comprising a plurality of inner teeth 308 on an inner edge 310 and a plurality of outer teeth 312 on an outer edge 314 of the conductive resonator 300 according to an embodiment of the disclosure. The conductive resonator 300 may have functions, material, and structures that are similar to the embodiments shown in FIGS. 1-2. Therefore common features, functions, and elements may not be redundantly described here. The conductive resonator 300 comprises an inner disk 302, a plurality of spokes 304, and a ring resonator 306 (conductive ring 306) comprising the inner teeth 308 distributed around the inner edge 310 of the ring resonator 306 and the outer teeth 312 distributed around the outer edge 314 of the ring resonator 306.

The inner disk 302 may comprise a tuning element for the conductive resonator 300. The inner disk 302 may be electrically coupled to the shorting pin 540 (FIG. 5) to provide connectivity to the electromagnetically-shielding ground plane 560 (FIG. 5). In an alternate embodiment, disk 302 may be omitted.

The spokes 304 electrically couple the ring resonator 306 to the inner disk 302. In the embodiment shown in FIG. 3, the conductive resonator 300 comprises the inner disk 302 and the ring resonator 306 coupled by one or more spoke 304. In an alternate embodiment, the one or more spoke 304 may be omitted, or the one or more spoke 304 of the conductive resonator 300 may be significantly enlarged to tune an antenna structure 500 (FIG. 5).

The ring resonator 306 may support an electromagnetic flux in a rotational circulation around the ring resonator 306. The ring resonator 306 may comprise a receiver that resonates an incoming electromagnetic signal producing the electromagnetic flux. The electromagnetic flux may be coupled by the feed lines 416 and 418 (FIG. 4) to provide a received signal to receiver electronics. Additionally or alternatively, the ring resonator 306 may comprise a transmitter that circulates the electromagnetic flux to resonate an outgoing electromagnetic signal. The electromagnetic flux may be coupled by feed lines to a transmit signal from transmitter electronics.

The inner teeth 308 and the outer teeth 312 on the outer edge 314 of the ring resonator 306 control a current flow around the ring resonator 306. Control of current flow allows for an antenna comprising the ring resonator 306 to have good circular polarization, good axial ratio over specified frequency bands, and allows the antenna to be matched to other electronic components (e.g. a receiver and/or transmitter). In the embodiment shown in FIG. 3, the inner teeth 308 and the outer teeth 312 comprise a substantially trapezoidal shape; however, the inner teeth 308 and the outer teeth 312 may comprise, for example but without limitation, a substantially square shape, a substantially triangular shape, a substantially polygonal shape, a substantially rounded shape, or other shape.

Furthermore, the inner teeth 308 (conductive teeth 308) may comprise a different shape than the outer teeth 312 (conductive teeth 312). The inner teeth 308 and the outer teeth 312 may each comprise an area of, for example but without limitation, about 10 $mm^2$, about 15 $mm^2$, or other suitable area for an application. The inner teeth 308 may comprise a length from the inner edge 310 of, for example but without limitation, about 3 mm, about 5 mm, or other suitable distance for an application. The outer teeth 312 may comprise a length from the outer edge 314 of, for example but without limitation, about 3 mm, about 5 mm, or other suitable distance for an application. While twenty of the inner teeth 308 are shown distributed around the inner edge 310 of the conductive resonator 300, in other embodiments other numbers of teeth may be used. While twenty of the outer teeth 312 are shown distributed around the outer edge 314 of the conductive resonator 300, in other embodiments other numbers of teeth may be used.

Figure 4:
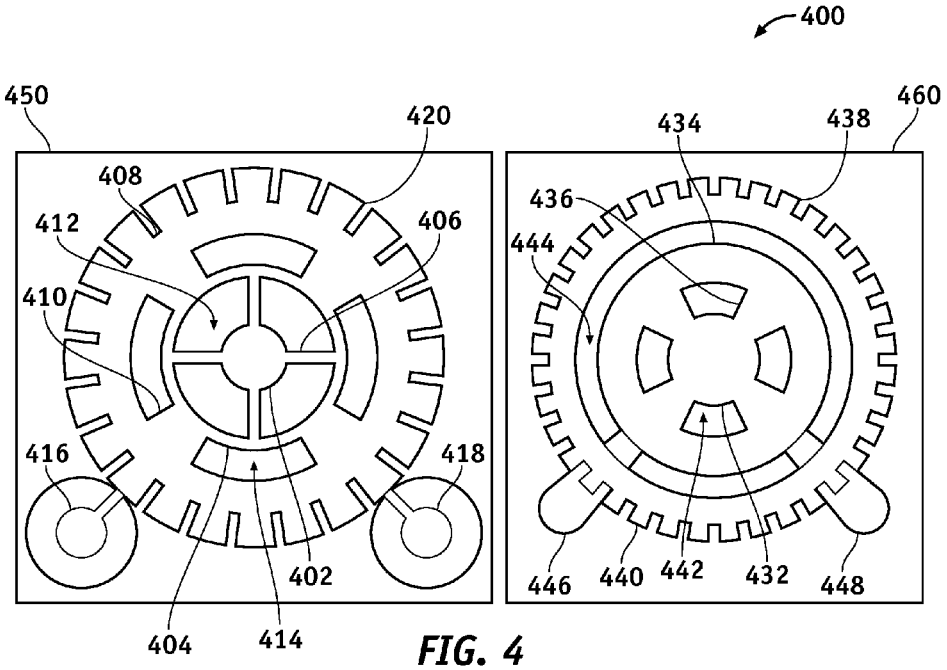
FIG. 4 is an illustration of exemplary cog ring conductive resonator configurations according to an embodiment of the disclosure.

FIG. 4 is an illustration of exemplary cog ring conductive resonator configurations 400 according to an embodiment of the disclosure. The conductive resonator configurations 400 may have functions, material, and structures that are similar to the embodiments shown in FIGS. 1-3. Therefore common features, functions, and elements may not be redundantly described here.

A cog ring conductive resonator 450 comprises a single band resonator. An inner disk 402 is coupled to an inner ring resonator 404 by a plurality of first spokes 406. The inner ring resonator 404 is coupled to an outer ring resonator 408 by a plurality of second spokes 410. The outer ring resonator 408 comprises a plurality of teeth 420. A plurality of first slot resonators 412 may be formed between the inner disk 402 and the inner ring resonator 404. A plurality of second slot resonators 414 may be formed between the inner ring resonator 404 and the outer ring resonator 408. The cog ring conductive resonator 450 may be excited by being driven by and/or driving a first feed line 416 and a second feed line 418.

A cog ring conductive resonator 460 comprises a dual band resonator. An inner disk 432 is coupled to an inner ring resonator 434 by a plurality of first spokes 436. An outer ring resonator 438 comprises a plurality of teeth 440. A plurality of first slot resonators 442 may be formed between the inner disk 432 and the inner ring resonator 434. A second slot resonator 444 may be formed between the inner ring resonator 434 and the outer ring resonator 438. The cog ring conductive resonator 460 may be excited by being driven by and/or driving a first feed line 446 and a second feed line 448.

FIG. 5 is an illustration of an exemplary antenna structure 500 (antenna structure 500) according to an embodiment of the disclosure. The antenna structure 500 may have functions, material, and structures that are similar to the embodiments shown in FIGS. 1-4. Therefore common features, functions, and elements may not be redundantly described here. The antenna structure 500 comprises a cog ring conductive resonator 530 (conductive resonator 530), feed lines 522, a faraday cage 550 comprising an electromagnetically-shielding ground plane 560, and a shorting pin 540.

The conductive resonator 530 uses the shorting pin 540 coupled from a top center of the conductive resonator 530 to the electromagnetically-shielding ground plane 560. The conductive resonator 530 comprises an inner disk 502 across a center of the conductive resonator 530 that provides connectivity to the shorting pin 540. This allows for the antenna structure 500 to extend the frequency coverage to comprise the commercials band of about 17.5-20.2 GHz, while retaining performance in the military bands of about 20.2-21.2 GHz. In an alternate embodiment, the shorting pin 540 may be omitted.

The conductive resonator 530 is operable to resonate at electromagnetic frequencies to be transmitted or received. The conductive resonator 530 may comprise, for example but without limitation, a single resonator, a plurality of resonators, slotted resonators, resonators on multiple layers, or other resonator. In the embodiment shown in FIG. 5, the conductive resonator 530 comprises a ring resonator 506 (FIG. 6) and at least one spoke 504. The ring resonator 506 may comprise, for example but without limitation, metallization, a microstrip, direct-write, or other suitable resonator.

Figure 6:
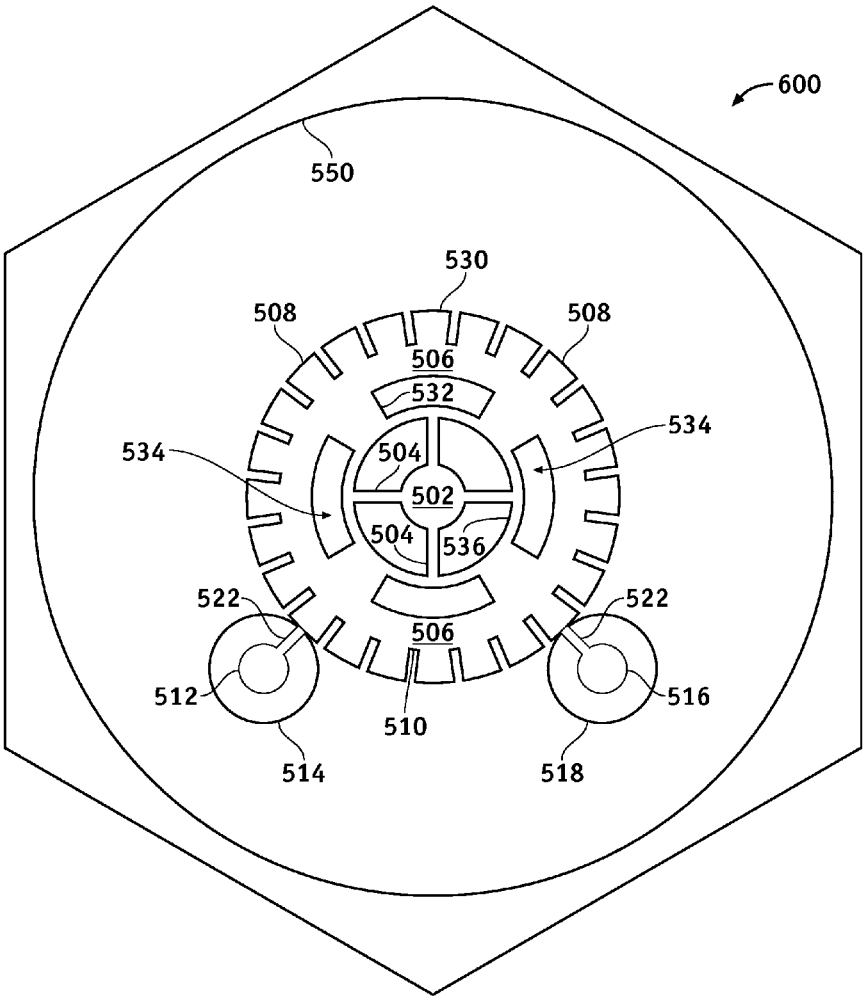
FIG. 6 is an illustration of an exemplary expanded partial top view of the antenna structure of FIG. 5 showing a conductive resonator in more detail according to an embodiment of the disclosure.

The conductive resonator 530 comprises an inner disk 502 (FIG. 6) and the ring resonator 506 coupled by one or more spoke 504, and the ring resonator 506 comprises one or more tuning slot 534 (FIG. 6). In various embodiments, various shapes and combinations of resonators may be used to form a single-band antenna operable in a single frequency band, a dual-band antenna operable in two frequency bands, or a multi-band antenna capable of operation in two or more frequency bands. For example but without limitation, the ring resonator 506 may be operable in an about 17.7-21.2 GHz frequency band.

Each of the feed lines 522 is electromagnetically coupled to the conductive resonator 530 and is configured to drive the conductive resonator 530 and/or receive a signal from the conductive resonator 530. The feed lines 522 may comprise, for example but without limitation, a single feed line 512/516, a plurality of feed lines 522, or any suitable configuration of feed lines. In the embodiment shown in FIG. 5, the feed lines 522 comprise a first feed line 512 coupled to a first signal line 514, and a second feed line 516 coupled to a second signal line 518. The first feed line 512 and the second feed line 516 may comprise, for example but without limitation, metallization, a microstrip, or other feed line. The feed lines 522 comprise microstrip feed lines electromagnetically coupled to the conductive resonator 530.

The electromagnetic coupling comprises, for example but without limitation, an inductive coupling, a capacitive coupling, or other electromagnetic coupling. The feed lines 522 may be located on a middle layer below the conductive resonator 530. For example but without limitation, the feed lines 522 may be located about 5 mm (about 20 mils) below the conductive resonator 530, or other suitable location. The feed lines 522 may be coupled to external electronics (not shown) using coupling vias through an electromagnetically-shielding ground plane 560 to the feed lines 522. The feed lines 522 may be spaced, for example but without limitation, about 90 degrees apart to allow for selectable right-hand circular polarized or left-hand circular polarized Satellite Communications (SATCOM) signals, or other suitable spacing.

The faraday cage 550 is configured to shield the conductive resonator 530 and the feed lines 522. In this manner, the faraday cage 550 may comprise, for example but without limitation, the electromagnetically-shielding ground plane 560, a first conductive strip 522, a second conductive strip 524, and a plurality of conductive vias 552. The conductive vias 552 are coupled to the electromagnetically-shielding ground plane 560, the first conductive strip 522, and the second conductive strip 524 to form an electrically conductive cage operable to isolate/shield the conductive resonator 530 and the feed lines 522 from bottom and side external electrical fields such as a neighboring antenna. The neighboring antenna may comprise, for example but without limitation, the antenna structure 500 as an element of a lattice 702 (FIG. 7), external antennas of neighboring devices, or other antenna. The faraday cage 550 may comprise, for example but without limitation, metallization, a microstrip, a circuit board material, direct write, or other suitable material.

Figure 7:
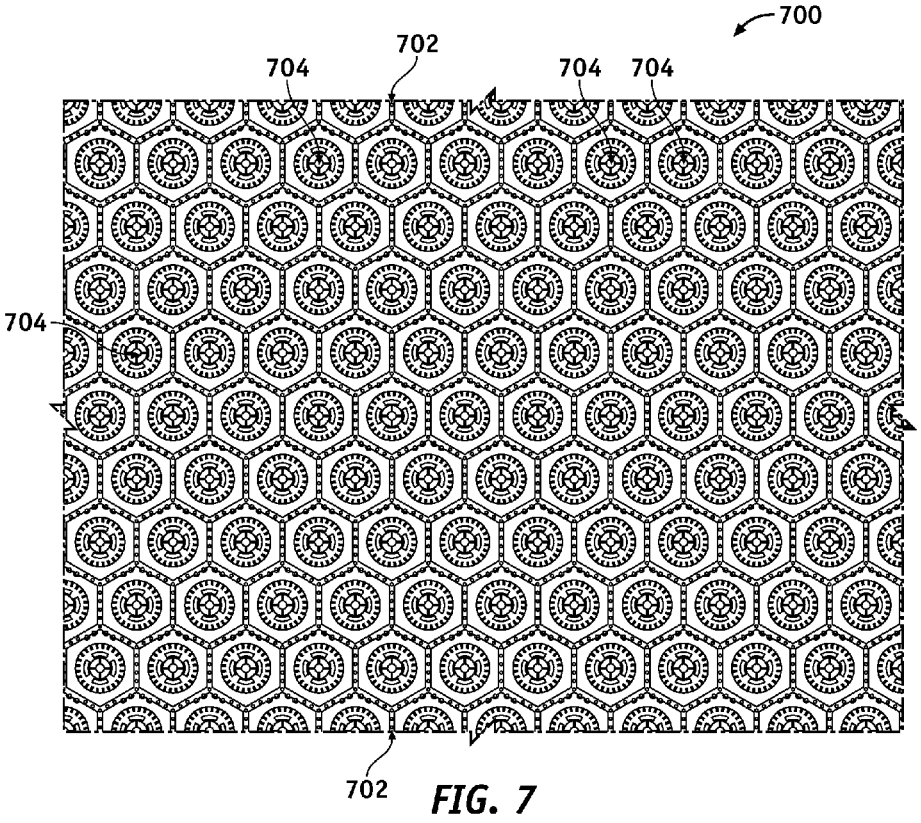
FIG. 7 is an illustration of an exemplary fabricated phased array antenna according to an embodiment of the disclosure.

The faraday cage 550 may comprise a periodic unit cell such as a unit cell 704 (antenna structure 704) in FIG. 7, with its outer boundary outline printed on layers of a circuit board with the conductive vias 552 extending from a top layer 554 of the antenna structure 500 to the electromagnetically-shielding ground plane 560. The faraday cage 550 may be made using any appropriate lattice spacing and shape to form a phased array antenna 700 (FIG. 7). The faraday cage 550 may comprise, for example but without limitation, a hexagonal lattice, a triangular lattice, a square lattice, or other shape. In this manner, the antenna structure 500 forms the phased array antenna 700 where conductive strips form the lattice 702 (FIG. 7).

The shorting pin 540 is electrically coupled to the conductive resonator 530 and the electromagnetically-shielding ground plane 560. The shorting pin 540 is operable to electrically couple the conductive resonator 530 to the electromagnetically-shielding ground plane 560. In an alternate embodiment, the shorting pin 540 may be omitted.

FIG. 6 is an illustration of an exemplary expanded partial top view 600 of the antenna structure 500 of FIG. 5 showing the conductive resonator 530 in more detail according to an embodiment of the disclosure. The conductive resonators 530 may have functions, material, and structures that are similar to the embodiments shown in FIGS. 1-5. Therefore common features, functions, and elements may not be redundantly described here. The antenna structure 500 comprises the conductive resonator 530, the feed lines 522, the faraday cage 550 comprising the electromagnetically-shielding ground plane 560, and the shorting pin 540. The antenna structure 600 may have functions, material, and structures that are similar to the embodiments shown in FIGS. 1-5. Therefore common features, functions, and elements may not be redundantly described here. The conductive resonator 530 is described in the context of discussion of FIGS. 1-5.

The conductive resonator 530 comprises a single band resonator. An inner disk 502 is coupled to an inner ring resonator 536 by a plurality of first spokes 504. The inner ring resonator 536 is coupled to an outer ring resonator 510 by a plurality of second spokes 532. The outer ring resonator 510 comprises a plurality of teeth 508. A plurality of first slot resonators 520 may be formed between the inner disk 502 and the inner ring resonator 536. A plurality of second slot resonators 534 may be formed between the inner ring resonator 536 and the outer ring resonator 510. The conductive resonator 530 may be excited by being driven by and/or driving the first feed line 512 and the second feed line 516.

The antenna structure 600 shown in FIG. 6 and the antenna structure 500 shown in FIG. 5 comprise the cog ring conductive resonator 530. However, the antenna structure 500/600 may comprise a cog ring conductive resonator configuration, such as but without limitation, the conductive resonator 100, 200, 300, 450 and 460, or other cog ring conductive resonator configuration.

Embodiments of the disclosure comprise a new cog shaped ring antenna element for use in phased array applications such as, for example but without limitation, high frequency SATCOM, Line of Sight communication systems, compact radar, radar, or other phased array systems. The antenna structure 500/600 (cog shaped antenna) can provide a wide scan volume better than 60 degrees of conical scan volume from boresight and maintain good circular polarization and axial ratio over specified frequency bands. The antenna structure 500/600 may comprise, for example but without limitation, multiple rings, cogs, various tuned elements, multi-layered circuit boards, a single or multiple ring resonator structure on a top surface combined with cog shaped ring structures or other relevant design features. Furthermore, the antenna structure 500/600 may comprise, for example but without limitation, rings structures that can be terminated with tuning tabs and a shorting pin to ground in the center, two microstrip feed lines on the middle layer (about 5 mm (about 20 mils) below the surface in a single ring design example) capacitively coupled to the ring structure on top and a ground plane on the lowest layer (about 10 mm (about 40 mils) below the surface in a design example), or other relevant design features.

This allows for the antenna structure 500/600 to have good circular polarization axial ratio over specified frequency bands and scan angular range in a phased array environment. The antenna structure 500/600 is operable to achieve a single band operation and is provided according to an embodiment of the disclosure. However, in other embodiments, various shapes and combinations of resonators may be used to form a single-band antenna operable in a single frequency band, or a multi-band antenna capable of operation in two or more frequency bands. For example but without limitation, the conductive resonator 100 is operable in adjacent commercial and military frequency bands covering about 17.7-21.2 GHz.

Design parameters may comprise: Number of cogs (teeth 108), cog thickness (not shown), and cog separation; an outer diameter and an inner diameter of the ring resonator 506; tabs used as part of the tuning shape; linked inner ring set with spokes and shorting cross/pin structure; board thickness and choice of circuit board materials; width lengths at a source and tip of the feed lines 522; placement of the feed lines 416/418/446/448/512/516/522; location of vias 552 providing source energy to the antenna; size and construction of the faraday cage 550 printed on the circuit boards; number of layers used, number and size of the vias 552 used to create the cage 550, or other design parameter.

FIG. 7 is an illustration of an exemplary fabricated phased array antenna 700 (structure 700) according to an embodiment of the disclosure. The structure 700 has functions, material, and structures that are similar to the antenna structure 500. Therefore, common features, functions, and elements may not be redundantly described here.

The structure 700 comprises multiple tuned elements, multi-layered circuit boards and relevant design features as explained above in the context of discussion of FIGS. 1-6. The structure 700 comprises a plurality of antenna structures 704 (antenna structure 500 in FIG. 5) as an element of the lattice 702 forming the fabricated phased array antenna 700. The antenna structures 704 provide an antenna array that allows for a single conformal aperture providing, for example but without limitation, a transmit and/or receive SATCOM aperture covering, for example but without limitation, transmit military bands of about 30-31 GHz, about 43.5-45.5 GHz with an ability to extend frequency coverage down to include adjacent commercial SATCOM Ka-bands at about 27.5-30 GHz, about 20.2-21.2 GHz for receive military band with extended frequency coverage down to include adjacent commercial SATCOM 17.7-20.2 GHz for receive military bands, or other frequency band.

In other embodiments, the antenna structures 704 provide an antenna array that allows for a single conformal aperture providing multi-band transmit and/or receive SATCOM aperture covering more than two frequency bands. In further embodiments, the antenna structures 704 provide an antenna array that allows for a single conformal aperture providing single-band transmit and/or receive SATCOM aperture covering a single frequency band.

In this manner, the fabricated phased array antenna 700 provides a wide scan volume, for example but without limitation, better than 60 degrees of conical scan volume from boresight, or other suitable scan volume, and maintains substantially good circular polarization axial ratio over specified frequency bands.

Figure 8:
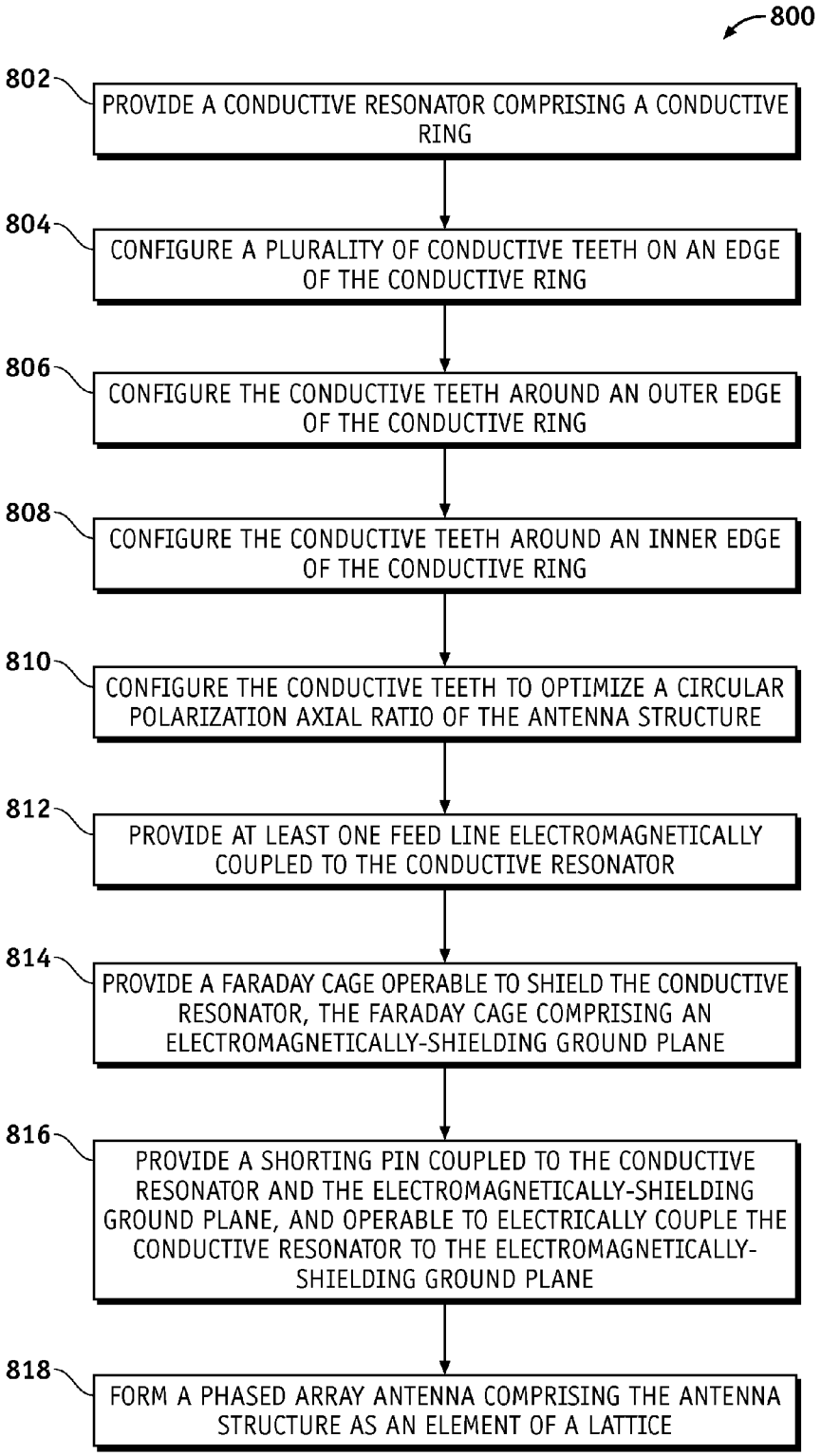
FIG. 8 is an illustration of an exemplary flowchart showing a manufacturing process for forming an antenna structure according to an embodiment of the disclosure.

FIG. 8 is an illustration of an exemplary flowchart showing an antenna structure manufacturing process 800 according to an embodiment of the disclosure. The various tasks performed in connection with process 800 may be performed mechanically, by software, hardware, firmware, or any combination thereof. It should be appreciated that process 800 may include any number of additional or alternative tasks, the tasks shown in FIG. 8 need not be performed in the illustrated order, and the process 800 may be incorporated into a more comprehensive procedure or process having additional functionality not described in detail herein.

For illustrative purposes, the following description of process 800 may refer to elements mentioned above in connection with FIGS. 1-7. In some embodiments, portions of the process 800 may be performed by different elements of the antenna structure 500 such as: the conductive resonator 100/200/300/450/460/530, the feed lines 416/418/446/448/512/516/522, the shorting pin 540, and the faraday cage 550, etc. The process 800 may have functions, material, and structures that are similar to the embodiments shown in FIGS. 1-7. Therefore common features, functions, and elements may not be redundantly described here.

Process 800 may begin by providing a conductive resonator such as the cog ring conductive resonator 100 comprising a conductive ring 106 (task 802).

Process 800 may continue by configuring a plurality of conductive teeth such as the conductive teeth 108 and/or the conductive teeth 208 on an edge of the conductive ring 106 (task 804).

Process 800 may continue by configuring the conductive teeth 108 around an outer edge of the conductive ring 106 such as the outer edge 110 (task 806).

Process 800 may continue by configuring the conductive teeth 208 around an inner edge of the conductive ring 206 such as the inner edge 210 (task 808).

Process 800 may continue by configuring the conductive teeth 108/208 to optimize a circular polarization axial ratio of an antenna structure such as the antenna structure 500 (task 810).

Process 800 may continue by providing at least one feed line such as the feed line 416/418/446/448/512/516 electromagnetically coupled to the conductive resonator 100/200/300/450/460/530 (task 812). As mentioned above, the feed lines 522 may be configured to drive the conductive resonator 100/200/300/450/460/530 and/or receive a signal from the conductive resonator 100/200/300/450/460/530, and may comprise, for example but without limitation, a single feed line, a plurality of feed lines, or any suitable configuration of feed lines, depending on antenna polarization requirements.

Process 800 may continue by providing a faraday cage such as the faraday cage 550 operable to shield a conductive resonator such as the conductive resonator 100/200/300/450/460/530, the faraday cage 550 comprising an electromagnetically-shielding ground plane such as the electromagnetically-shielding ground plane 560 (task 814).

Process 800 may continue by providing a shorting pin such as the shorting pin 540 coupled to the conductive resonator 100/200/300/450/460/530 and the electromagnetically-shielding ground plane 560, and operable to electrically couple the conductive resonator 100/200/300/450/460/530 to the electromagnetically-shielding ground plane 560 (task 816). The faraday cage 550 minimizes a substrate guided wave propagation and mutual coupling with at least one neighboring conductive resonator 100/200/300/450/460/530 using (task 920). The combination of design features mentioned above and the faraday cage 550 (FIG. 1) minimize a substrate/ground plane guided wave propagation (e.g., through shielding of the electromagnetically-shielding ground plane 560). The combination of design features mentioned above and the faraday cage 550 also minimize a mutual coupling between neighboring conductive resonators (e.g., conductive resonator 100/200/300/450/460/530) of adjacent antenna elements such as adjacent antenna structures 500.

Process 800 may continue by forming a phased array antenna such as the phased array antenna 700 comprising the antenna structure 500 as an element of a lattice such as the lattice 702 (task 818). Minimizing the substrate/ground plane guided wave propagation and the mutual coupling between neighboring conductive resonators (e.g., conductive resonator 100/200/300/450/460/530) of adjacent antenna elements allows the phased array antenna 700 (FIG. 7) to scan down near a horizon. Scanning down near the horizon can provide functionality suitable for a phased array for SATCOM or other application requiring wide scan volume. A neighboring conductive resonator may comprise the conductive resonator 100/200/300/450/460/530 of the adjacent antenna structure 500 of the phased array antenna 700.

Figure 9:
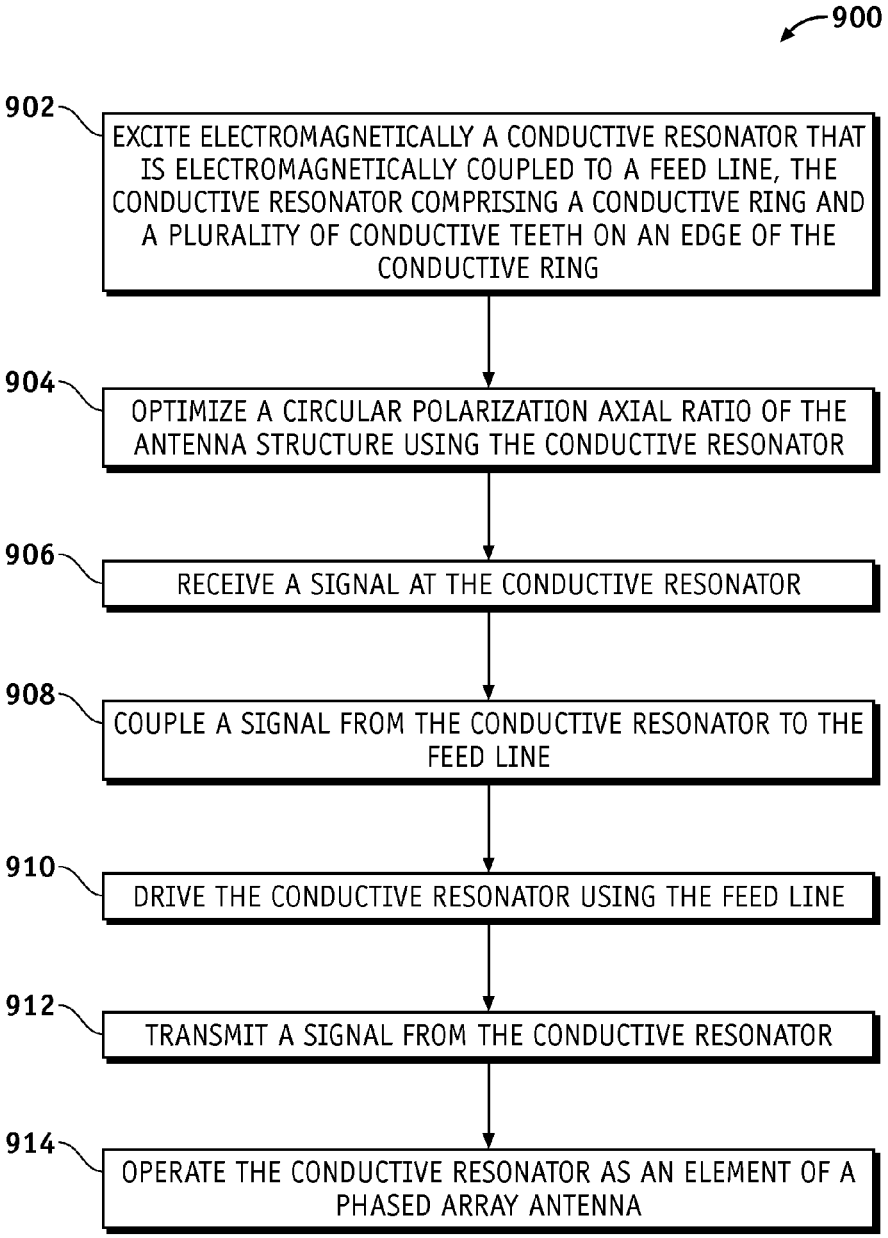
FIG. 9 is an illustration of an exemplary flowchart showing a process for communication using an antenna structure according to an embodiment of the disclosure.

FIG. 9 is an illustration of an exemplary flowchart showing a process 900 for communication using the phased array antenna 700 comprising the antenna structure 500 according to an embodiment of the disclosure. The various tasks performed in connection with process 900 may be performed mechanically, by software, hardware, firmware, or any combination thereof. It should be appreciated that process 900 may include any number of additional or alternative tasks, the tasks shown in FIG. 9 need not be performed in the illustrated order, and the process 900 may be incorporated into a more comprehensive procedure or process having additional functionality not described in detail herein.

For illustrative purposes, the following description of process 900 may refer to elements mentioned above in connection with FIGS. 1-7. In some embodiments, portions of the process 900 may be performed by different elements of the antenna structure 500 such as: the conductive resonator 100/200/300/450/460/530, the feed line 416/418/446/448/512/516, the shorting pin 540, the faraday cage 550, etc. The process 900 may have functions, material, and structures that are similar to the embodiments shown in FIGS. 1-7. Therefore common features, functions, and elements may not be redundantly described here.

Process 900 may begin by exciting electromagnetically a conductive resonator such as the conductive resonator 100/200/300/450/460/530 that is electromagnetically coupled to a feed line such as the feed line 416/418/446/448/512/516, the conductive resonator comprises a conductive ring such as the conductive ring 106/206/306/408/438 and a plurality of conductive teeth such as the conductive teeth 108/208/308/312/420/440/508 on an edge of the conductive ring 106/206/306/408/438 (task 902). Each of conductive ring 106/206/306/408/438 may support an electromagnetic flux (current) in a rotational circulation around resonator each respective conductive ring 106/206/306/408/438. The conductive teeth 108/208/308/312/420/440/508 are teeth distributed around an edge of the conductive ring, and control a flow of the electromagnetic current and tune a response of the antenna structure 500.

Process 900 may continue by optimizing a circular polarization axial ratio of the antenna structure using the conductive resonator (task 904).

Process 900 may continue by receiving a signal at the conductive resonator 100/200/300/450/460/530 (task 906).

Process 900 may continue by coupling the signal from the conductive resonator 100/200/300/450/460/530 to the feed line 416/418/446/448/512/514 (task 908).

Process 900 may continue by driving the conductive resonator 100/200/300/450/460/530 using the feed line 416/418/446/448/512/516 (task 910).

Process 900 may continue by transmitting a signal from the conductive resonator 100/200/300/450/460/530 (task 912).

Process 900 may continue by operating the conductive resonator 100/200/300/450/460/530 as an element of a phased array antenna such as the phased array antenna 700 (task 914).

In this way, embodiments of the disclosure provide antenna systems and methods that minimize size, weight, and power (SWAP), as well as minimizing integration cost. As mentioned above, the SWAP is greatly reduced by elimination of "stovepiped" SATCOM banded systems and associated separate antenna installations. Embodiments provide a phased array antenna that can cover at least one SATCOM transmit and/or receive military EHF band, while being thin and lightweight. Embodiments can be scaled to other frequency bands and phased array antenna applications such as, for example but without limitation, Line-of-Sight communication links, SIGINT arrays, radars, sensor arrays, and the like. Embodiments of the disclosure provide a conformal antenna operable to greatly reduce aerodynamic drag and integration/maintenance cost.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-7 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. The term "about" when referring to a numerical value or range is intended to encompass values resulting from experimental error that can occur when taking measurements.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. An antenna array structure comprising:

an antenna array element comprising a conductive resonator, the conductive resonator comprising:

a conductive ring operable to support an electromagnetic current, and comprising an inner edge and an outer edge; and a plurality of conductive teeth distributed around an edge comprising the inner edge or the outer edge of the conductive ring, and operable to control a flow of the electromagnetic current and tune a response of the antenna array structure, wherein the conductive teeth comprise a longest length away from the edge that is smaller than a shortest distance between the inner edge and the outer edge of the conductive ring, and wherein the conductive teeth comprise first teeth distributed around the inner edge that are a first longest length away from the inner edge that is smaller than the shortest distance between the inner edge and the outer edge of the conductive ring, and second teeth distributed around the outer edge of the conductive ring that are a second longest length away from the outer edge that is smaller than the shortest distance between the inner edge and the outer edge of the conductive ring; and at least two feed lines electromagnetically coupled to the conductive resonator, wherein the two feed lines are spaced apart by approximately 90 degrees.

2. The antenna array structure according to claim 1, further comprising a lattice faraday cage operable to shield the conductive resonator, the lattice faraday cage comprising an electromagnetically-shielding ground plane.

3. The antenna array structure according to claim 2, further comprising a shorting pin coupled to the conductive resonator and the electromagnetically-shielding ground plane, and operable to electrically couple the conductive resonator to the electromagnetically-shielding ground plane.

4. The antenna array structure according to claim 1, further comprising the feed lines configured to selectable enable one of right-hand circular polarization or left-hand circular polarization.

5. The antenna array structure according to claim 1, wherein the conductive resonator comprises at least one member selected from the group consisting of: a spoke structure, a ring structure, and a substantially planar shape.

6. The antenna array structure according to claim 1, wherein the conductive resonator is configured to optimize a circular polarization axial ratio and bandwidth tuning of the antenna array structure.

7. A method for forming an antenna array structure, the method comprising:

configuring an antenna array element comprising a conductive resonator, the conductive resonator comprising a conductive ring comprising an inner edge and an outer edge; and configuring a plurality of conductive teeth on an edge comprising the inner edge or the outer edge of the conductive ring, wherein the conductive teeth comprise a longest length away from the edge that is smaller than a shortest distance between the inner edge and the outer edge of the conductive ring, and wherein the conductive teeth comprise first teeth distributed around the inner edge that are a first longest length away from the inner edge that is smaller than the shortest distance between the inner edge and the outer edge of the conductive ring, and second teeth distributed around the outer edge of the conductive ring that are a second longest length away from the outer edge that is smaller than the shortest distance between the inner edge and the outer edge of the conductive ring; and configuring at least two feed lines to electromagnetically couple to the conductive resonator, wherein the two feed lines are spaced apart by approximately 90 degrees.

8. The method according to claim 7, further comprising configuring the conductive teeth to optimize a circular polarization axial ratio and bandwidth tuning of the antenna array structure.

9. The method according to claim 7, further comprising configuring the conductive resonator to comprise a spoke structure, and the antenna array element to comprise a substantially planar shape.

10. The method according to claim 7, further comprising the feed lines configured to selectable enable one of right-hand circular polarization or left-hand circular polarization.

11. The method according to claim 7, further comprising configuring a lattice faraday cage comprising an electromagnetically-shielding ground plane to shield the conductive resonator.

12. The method according to claim 11, further comprising coupling a shorting pin to the conductive resonator and the electromagnetically-shielding ground plane, the shorting pin operable to electrically couple the conductive resonator to the electromagnetically-shielding ground plane.

13. The method according to claim 7, further comprising forming a phased array antenna comprising the antenna array structure as an element of a lattice.

14. A method for communication using an antenna array structure, the method comprising:

exciting electromagnetically an antenna array element comprising a conductive resonator electromagnetically coupled to at least two feed lines, wherein the two feed lines are spaced apart by approximately 90 degrees, the conductive resonator comprising:

a conductive ring operable to support an electromagnetic current, and comprising an inner edge and an outer edge; and a plurality of conductive teeth distributed around an edge comprising the inner edge or the outer edge of the conductive ring, and operable to control a flow of the electromagnetic current and tune a response of the antenna array structure, wherein the conductive teeth comprise a longest length away from the edge that is smaller than a shortest distance between the inner edge and the outer edge of the conductive ring, and wherein the conductive teeth comprise first teeth distributed around the inner edge that are a first longest length away from the inner edge that is smaller than the shortest distance between the inner edge and the outer edge of the conductive ring, and second teeth distributed around the outer edge of the conductive ring that are a second longest length away from the outer edge that is smaller than the shortest distance between the inner edge and the outer edge of the conductive ring.

15. The method according to claim 14, further comprising optimizing a circular polarization axial ratio of the antenna array structure using the conductive resonator.

16. The method according to claim 14, further comprising:

receiving a signal at the conductive resonator; and coupling the signal from the conductive resonator to the feed line.

17. The method according to claim 14, further comprising:

driving the conductive resonator using the feed line; and transmitting a signal from the conductive resonator.

18. The method according to claim 14, further comprising operating the conductive resonator as an element of a phased array antenna.

* * * * *